US007381028B2

(12) United States Patent
Hancock et al.

(10) Patent No.: US 7,381,028 B2
(45) Date of Patent: Jun. 3, 2008

(54) COMPOSITE AIR HANDLING BLOWER HOUSING AND METHOD OF ASSEMBLY

(75) Inventors: Stephen S. Hancock, Glint, TX (US); Mark D. Woodruff, Tyler, TX (US); Scott A. Salvage, Tyler, TX (US); Leslie L. Zinger, Frankston, TX (US)

(73) Assignee: Trane International Inc., New York, NY (US)

( * ) Notice: Subject to any disclaimer, the term of this patent is extended or adjusted under 35 U.S.C. 154(b) by 163 days.

(21) Appl. No.: 10/796,703

(22) Filed: Mar. 9, 2004

(65) Prior Publication Data

US 2004/0253101 A1 Dec. 16, 2004

Related U.S. Application Data

(63) Continuation-in-part of application No. 10/461,042, filed on Jun. 13, 2003, now Pat. No. 7,014,422.

(51) Int. Cl.
*F04D 29/42* (2006.01)

(52) U.S. Cl. ..... 415/214.1; 29/888.022

(58) Field of Classification Search ..... 415/214.1, 415/215.1, 204; 29/888.022, 888.024, 889.022; 406/326, 329

See application file for complete search history.

(56) References Cited

U.S. PATENT DOCUMENTS 4,865,517 A * 9/1989 Beehler ..... 415/214.1
5,474,422 A * 12/1995 Sullivan ..... 415/206

FOREIGN PATENT DOCUMENTS

| | | |
|---|---|---|
| EP | 0 985 829 A2 | 3/2000 |
| EP | 1 094 224 A2 | 4/2001 |
| WO | WO 95/32363 | 11/1995 |
| WO | WO 9532363 A1 * | 11/1995 |

OTHER PUBLICATIONS

Crawford, R.J. "Plastics Engineering." Elsevier, 1998. p. 5-6, 8-9.*
Publication: "The Leader", Title: "New Air Handler Features Better Performance in a Smaller Cabinet", Spring 2004, p. 6, vol. 13, Issue 1.

* cited by examiner

*Primary Examiner*—Richard Edgar
(74) *Attorney, Agent, or Firm*—William O'Driscoll

(57) ABSTRACT

An air handling blower housing for an HVAC system is formed by two opposed housing parts which are each fabricated of a compression molded reinforced thermoset polymer composition. The housing parts are joined along a parting line, preferably perpendicular to the axis of a motor driven impeller mounted within the housing by wedge shaped clips which engage cooperating bosses aligned with each other when the housing parts are joined. The construction of the housing parts provides for an improved method of assembly of an air handling blower of a type particularly adapted for HVAC systems.

22 Claims, 8 Drawing Sheets

FIG. 4
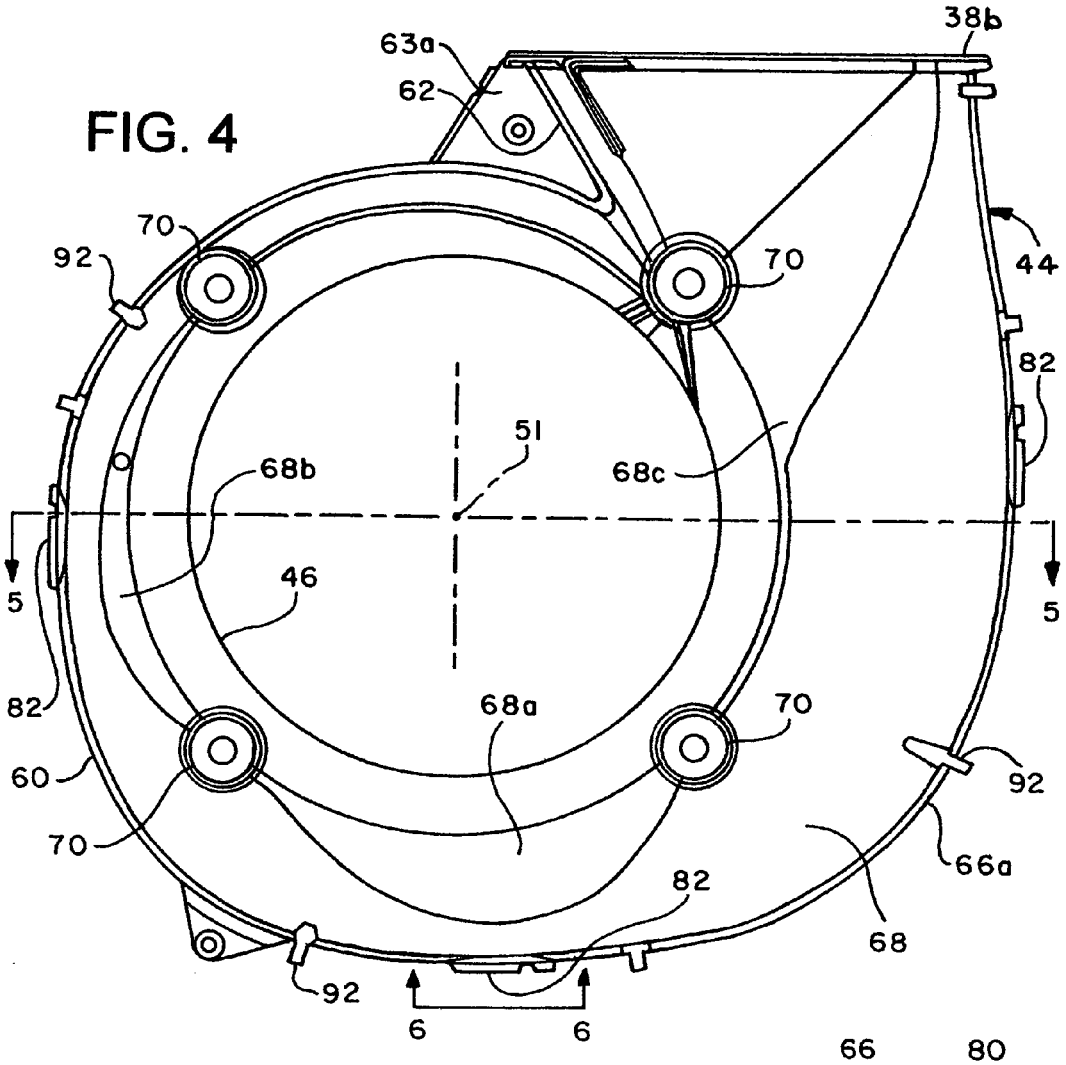
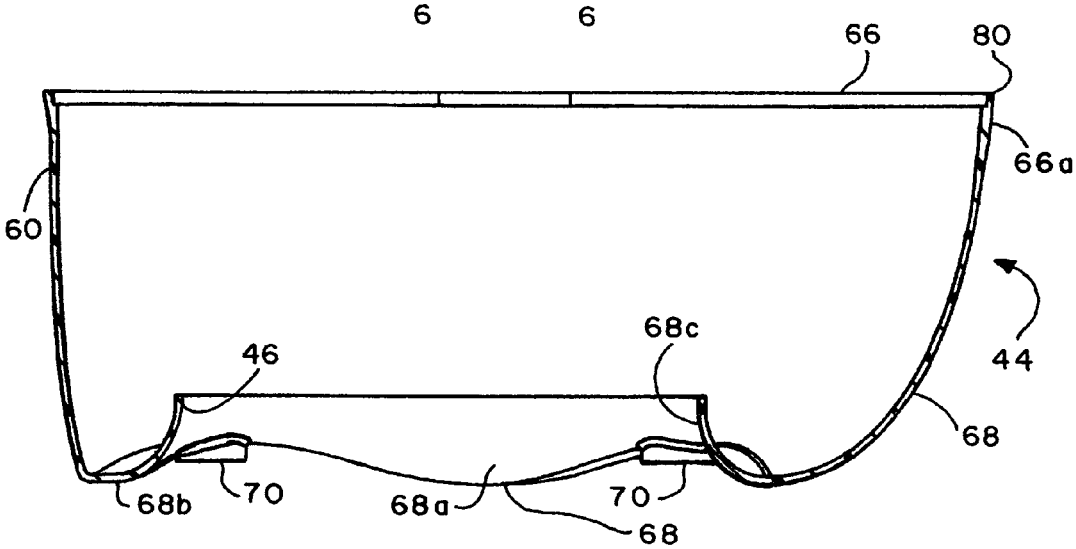
FIG. 5

COMPOSITE AIR HANDLING BLOWER HOUSING AND METHOD OF ASSEMBLY

CROSS REFERENCE TO RELATED APPLICATION

This application is a continuation-in-part of U.S. patent application Ser. No. 10/461,042, filed Jun. 13, 2003 now U.S. Pat. No. 7,014,422.

BACKGROUND OF THE INVENTION

Centrifugal, as well as axial flow type, air handling blowers are widely used for circulating air in residential and commercial heating, ventilating and air conditioning (HVAC) systems. Electric motor driven centrifugal blowers or fans mounted in volute type blower housings are particularly widely used in residential HVAC systems. Substantially all HVAC blower housings are fabricated from sheet metal parts which are clamped or welded together to form the somewhat complex geometry of the blower housing.

The disadvantages of sheet metal housings are recognized, including susceptibility to corrosion, the cost of manufacturing and the hazards associated with fabricating sheet metal parts that have sharp edges and corners which can injure persons handling the blower housing as well as the final blower assembly. Moreover, sheet metal blower housings tend to amplify acoustic vibrations, become easily scratched thus removing any protective coatings and are somewhat cumbersome to insert within an HVAC unit cabinet without damaging the cabinet due to sharp edges and weight of the housing structure. Still further, recent developments in blower housing construction which require complex geometric shapes, including compound curved surfaces, also require complex and costly metal forming techniques.

Accordingly, improvements in blower housing construction for centrifugal and axial flow blowers used in HVAC systems have been desired and needed. The use of other materials in blower housing construction has been considered. Thermoplastic materials, by their nature, become hard and brittle at low temperatures and soft at high temperatures and the wide range of temperatures to which blower housings are subjected in HVAC systems is not conducive to the use of thermoplastics. Moreover, the wide range of temperatures to which HVAC system blower housings are subjected also requires, or makes highly desirable, the use of a material with a coefficient of thermal expansion similar to that of steel or similar metals, and a material which is subject to negligible creep at higher temperatures.

Accordingly, the problems associated with the development of air handling blower housings, particularly for HVAC systems, include the need to provide resistance to corrosion, negligible material creep, lack of brittleness when cold or softness when hot, a coefficient of expansion similar to steel or similar metals, chemical resistance, reduced acoustic transmissions and ease of fabricating complex housing shapes. A solution to the aforementioned problems and a desire to provide a blower housing configuration which provides an improved method of assembly have resulted in the development of the present invention.

SUMMARY OF THE INVENTION

The present invention provides an improved air handling blower, particularly of the type used in HVAC systems. More particularly, the present invention provides an improved air handling blower housing which is formed of a composite material, has a configuration which facilitates ease of assembly and provides several advantages in the art of air handling blowers previously unrealized.

In accordance with an important aspect of the present invention, an air handling blower housing is provided which is molded of a thermoset composite material, in particular, a reinforced thermoset polymer material. The blower housing is preferably formed by compression molding using a bulk or sheet molding compound of a thermoset polymer, preferably reinforced with glass fibers or other suitable reinforcements. Formation of the blower housing using a molded thermoset composite material eliminates corrosion problems, sharp edges or corners on the blower housing, provides for negligible creep, brittleness or softness when exposed to temperature extremes common in blower applications in HVAC systems and provides a coefficient of thermal expansion similar to that of a metal, such as steel.

In accordance with another aspect of the present invention, a blower housing is provided which is advantageously formed of two housing parts which are formed about a parting line disposed in a plane generally normal to the axis of rotation of a centrifugal blower impeller or "wheel."

In accordance with yet another aspect of the present invention, a thermoset composite blower housing is provided which includes complex, compound curved surfaces whereby the material thickness of the walls of the housing may be minimized without sacrificing strength. The complex curved shape of the blower housing is also conducive to being formed by a molding process, such as a bulk or sheet compression molding method.

In accordance with a further aspect of the present invention, a blower housing is provided which is of a configuration which facilitates ease of assembly. A two part housing is provided whereby the housing parts may be easily secured to each other by plural spaced apart clips or cleats which may be snapped onto and off of cooperating clip mounting bosses molded on the respective housing parts thereby facilitating ease of assembly and disassembly of the housing. The improved blower housing of the present invention also provides for an advantageous method of assembly of a complete blower, including a blower motor and impeller.

Those skilled in the art will further appreciate the above-mentioned advantages and superior features of the invention together with other important aspects thereof upon reading the detailed description which follows in conjunction with the drawings.

BRIEF DESCRIPTION OF THE DRAWINGS

FIG. 4 is an opposite side elevation of the blower housing part shown in FIG. 3;

FIG. 5 is a section view taken along line 5-5 of FIG. 4;

DETAILED DESCRIPTION OF THE PREFERRED EMBODIMENTS

Figure 1:
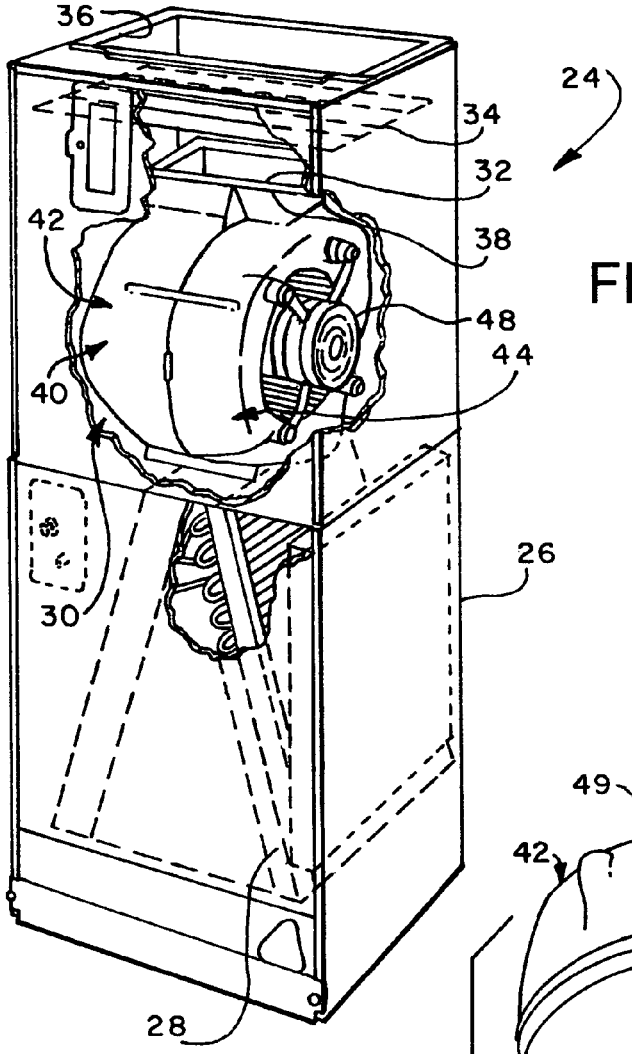
FIG. 1 is cutaway perspective view of an HVAC system, such as an air handler, including an air circulating blower in accordance with the present invention.

In the description which follows like elements are marked throughout the specification and drawings with the same reference numerals, respectively. The drawing figures are not necessarily to scale and certain elements may be shown exaggerated in scale or in somewhat generalized or schematic form in the interest of clarity and conciseness.

Referring to FIG. 1, there is illustrated a portion of an HVAC system, generally designated by the numeral 24. The HVAC system 24 comprises a generally rectangular cabinet 26 in which is disposed a so-called A frame shaped heat exchange coil 28 which may be for cooling, as well as heating, of airflow through the cabinet. Typically, airflow is introduced into the cabinet 26 through a bottom wall opening, not shown, for upward flow through the A frame heat exchange coil 28, as induced by an air handling centrifugal blower in accordance with the invention and generally designated by the numeral 30. The blower 30 is disposed in the cabinet 26 for discharge of air through a blower outlet or air discharge opening 32 which may be disposed directly below a heating source, such as an electric resistance grid 34. Air is discharged from the cabinet 26 through a cabinet top wall air discharge opening 36. Blower 30 includes a perimeter flange 38 defining the discharge opening 32 and engaged with cooperating blower support rails formed in the cabinet 26, not shown in FIG. 1. The aforementioned support rails engage portions of the perimeter flange 38 to provide substantially total support for the blower 30 within the cabinet 26 in the position shown.

Figure 2:
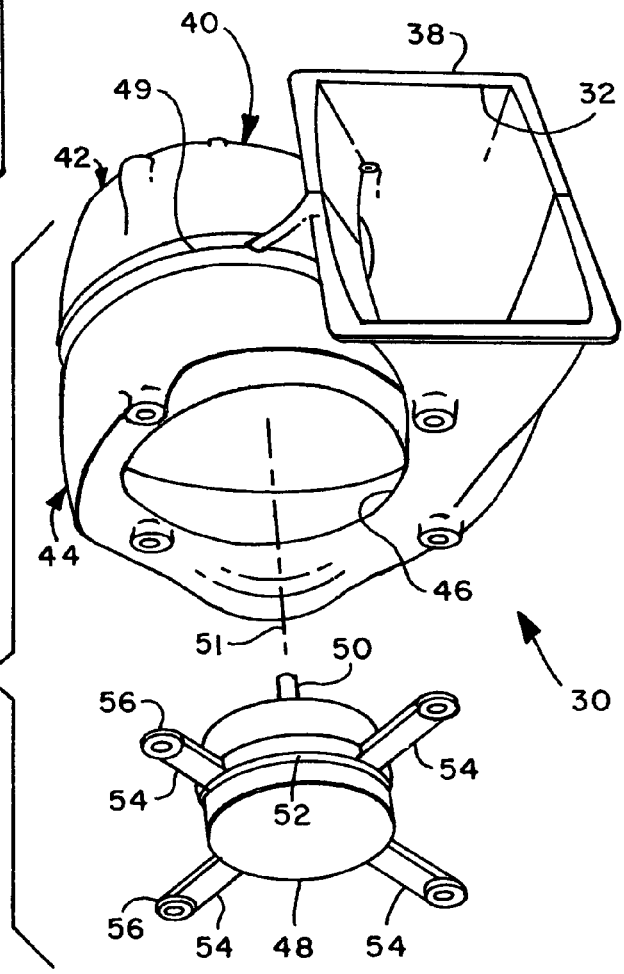
FIG. 2 is an exploded perspective view of the blower housing of the present invention shown together with a conventional electric blower motor and support bracket assembly therefor.

Referring also to FIG. 2, the blower 30 is shown partially disassembled and is characterized by a so-called volute or scroll type housing 40 which is formed by separable parts 42 and 44, which may be somewhat mirror image parts with respect to each other, and which form an enclosure in which may be supported a centrifugal impeller, not shown in FIG. 2. Air flows into the blower housing 40 by way of opposed generally circular inlet openings, one of which is formed in housing part 44, as shown in FIG. 2, and generally designated by the numeral 46. Housing parts 42 and 44 cooperate to provide the perimeter flange 38 which is generally rectangular in configuration and housing parts 42 and 44 also cooperate to define the generally rectangular blower air discharge opening 32.

Referring further to FIG. 2, blower 30 includes an electric impeller drive motor 48 having a rotatable output shaft 50 and a support bracket 52 provided with plural circumferentially spaced radially projecting arms 54. Each arm 54 terminates in a generally circular boss 56 for receiving a fastener for securing the motor 48 to the housing part 44 of blower housing 40.

The blower housing 40 illustrated in the drawing figures may be of a type disclosed in my co-pending U.S. patent application Ser. No. 10/461,042 filed Jun. 13, 2003, entitled Rounded Blower Housing With Increased Air Flow. Blower housing 40, as illustrated, includes a volute type air discharge flow path which is of substantially constantly increasing cross-sectional area between the so-called impeller cutoff point and the air discharge opening 32, but the increase in area is not entirely due to a continuously increasing distance of an outer peripheral end wall of the blower housing with respect to the impeller axis of rotation, which is the configuration of conventional blower housings. The aforementioned continuously increasingly flow area is provided at least in part by axially displaced portions of the housing part sidewalls which are preferably formed to provide continuous curved surfaces and to provide for increasing airflow area between the blower impeller cutoff point and the housing discharge opening while also providing for reduced overall dimensions of the blower housing.

The blower housing 40 is advantageously fabricated of a reinforced thermoset polymer material whereby the respective blower housing parts 42 and 44, making up the entire blower housing, are each compression molded of a reinforced thermoset polymer material, such as a glass fiber reinforced polyester. The housing parts 42 and 44, as shown in FIG. 2, are joined along a parting line 49 which lies in a plane substantially normal to an axis 51, which axis is also the axis of rotation of the motor output shaft 50 and is a central axis of the blower air inlet opening 46, see FIGS. 3 and 4 also.

Figure 3:
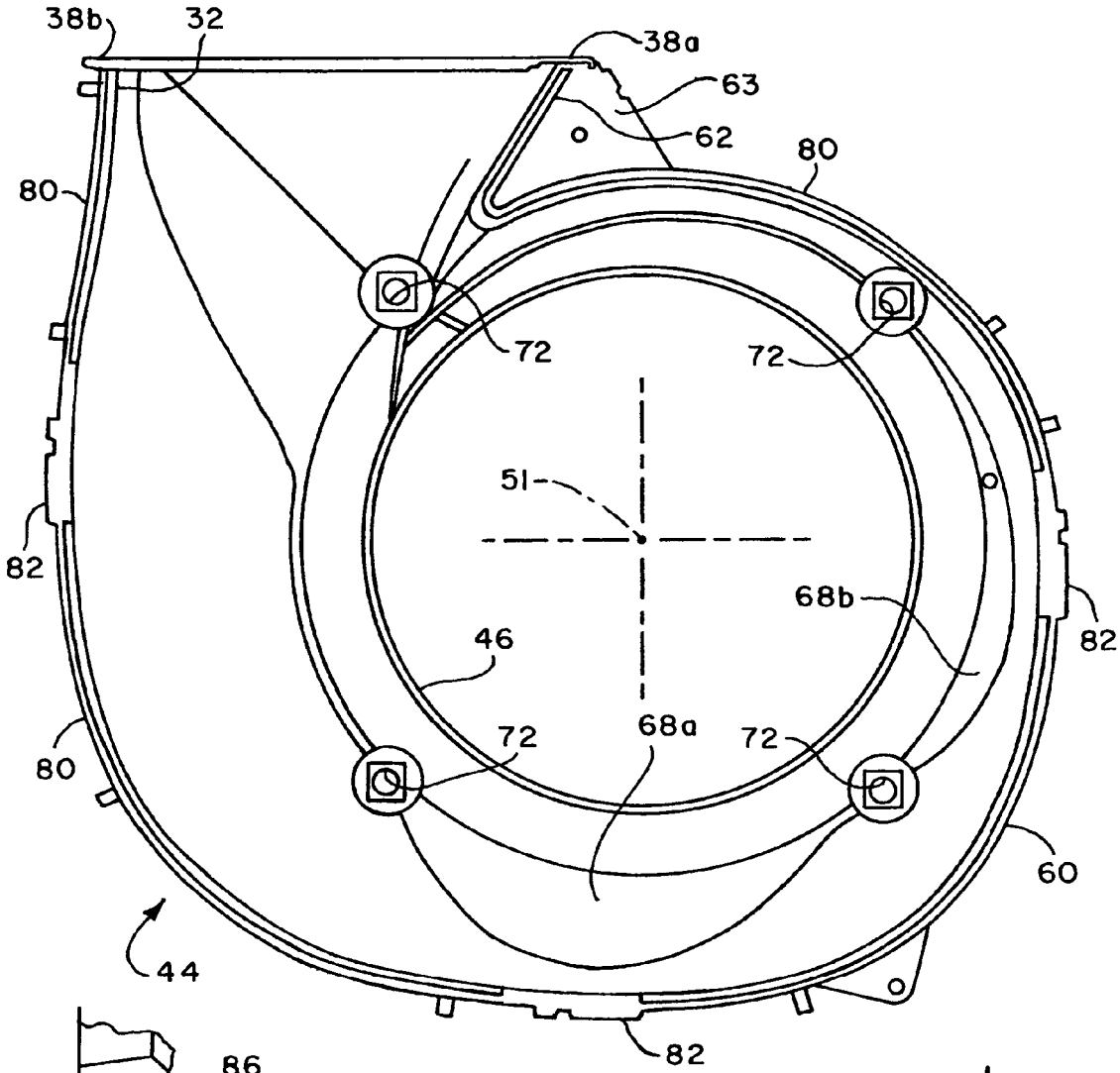
FIG. 3 is a side elevation of one part of the blower housing of the present invention.

Referring now to FIGS. 3, 4 and 5, the blower housing part 44 includes a continuous outer end wall 60 which extends from a wall portion 62, which terminates at a portion of flange 38 designated as 38*a*. Outer wall 60 extends to a point of termination at an opposite part of flange 38 and designated as 38*b*. The curvature of wall 60 is, preferably, not constant, nor does wall 60 continually increase its distance from axis 51 in the same manner as conventional scroll or volute blower housings, as indicated in drawing FIGS. 3 and 4. A gusset 63*a* is formed between wall portions 60 and 62 and lies, preferably, directly adjacent one side edge of housing part 44, which edge is designated by the numeral 66 in FIG. 5. Side edge 66 has a thickened area 66*a*, FIG. 5, which is substantially continuous along wall 60 between flanges 38*a* and 38*b* and including the wall portion 62.

Referring further to FIGS. 4 and 5, the housing part 44 includes a curved sidewall 68 which extends between inlet opening 46 and outer end wall 60 and which may have variable contour, as illustrated. The shape or contour of the wall 68 as well as the wall 60 may be in accordance with the geometry of the blower housing disclosed in application Ser. No. 10/461,042, which is incorporated herein by reference. Thus, compound curved and axially extending surfaces, including surfaces 68*a* and 68*b*, FIG. 4, are formed by the walls 60 and 68, for example. Sidewall 68 also forms compound curved surface 68*c* which terminates at inlet opening 46. Housing part 44 is provided with four spaced apart bosses 70 which are adapted to support respective threaded fastener inserts such as threaded nuts, not shown, and retained by press fitting in recesses 72 on the inner facing sides of the bosses, see FIG. 3. The bosses 70 are adapted to engage the bosses 56 formed on the motor support bracket 52 whereby suitable threaded fasteners, not shown in FIGS. 3, 4 and 5, may be used to mount the motor 48 on the housing part 44, as illustrated in FIG. 1. The diameter of the motor 48 is, of course, somewhat less than the diameter of the inlet opening 46 to permit air flow into the interior of the housing 40 through the opening 46 as well as a corresponding blower air inlet opening in housing part 42, which will be described further herein.

Figure 6:
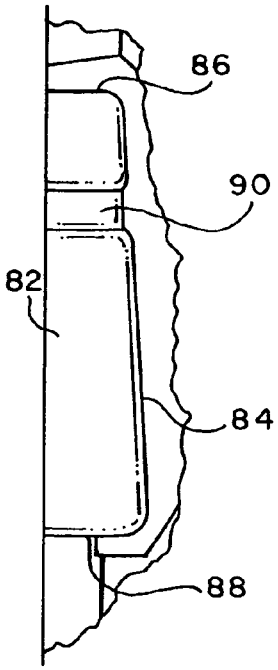
FIG. 6 is a detail plan view taken generally from the line 6-6 of FIG. 4 showing the configuration of a boss adapted to receive a clip or cleat type fastener for securing opposed blower housing parts to each other.
Figure 7:
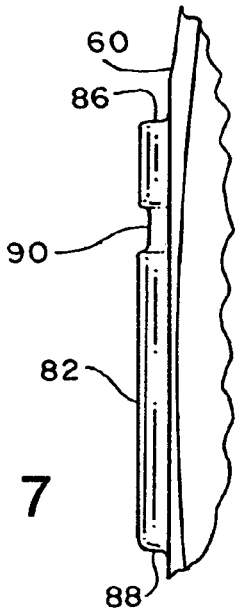
FIG. 7 is a detail side elevation of the boss shown in FIG. 6.
Figure 16:
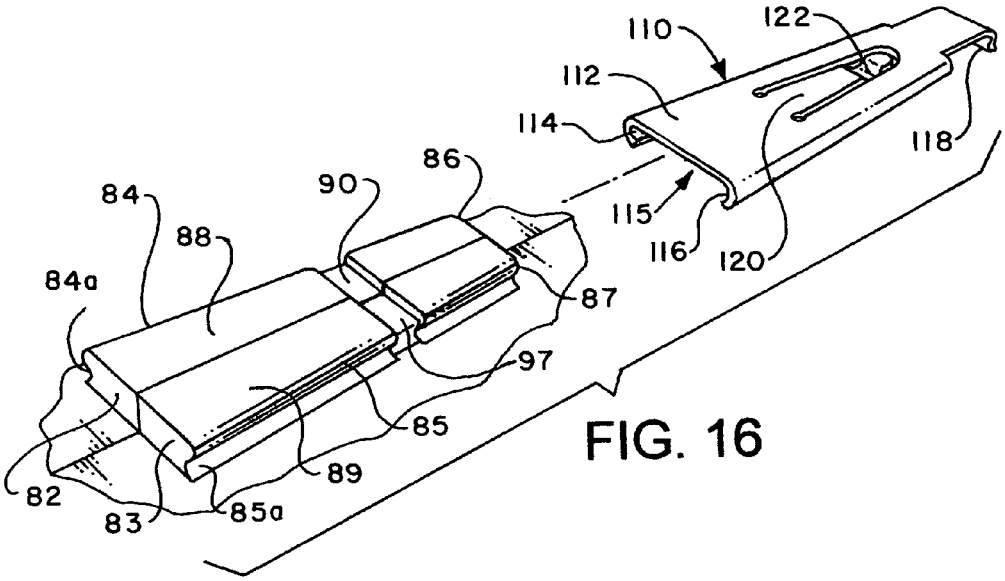
FIG. 16 is a detail perspective view showing the clip illustrated in FIGS. 14 and 15 disposed to be moved into a working position in engagement with cooperating bosses on the blower housing parts of the present invention.

Housing part 44 is provided with an axially projecting perimeter flange 80 at edge 66, see FIGS. 3 and 5, which is intersected by spaced apart tapered bosses 82 formed on and integral with the outer wall 60 as shown in FIGS. 3, 4, 6, 7 and 16. Each of the bosses 82 has a shape generally as illustrated in FIGS. 6, 7 and 16, and includes a tapered wall portion 84 extending between transverse ends 86 and 88. A transverse groove 90 is formed in each boss 82 relatively close to the transverse end 86, see FIG. 6. Each of the bosses 82 cooperates with a boss having essentially a mirror image shape and formed on housing part 42, as will be described in further detail herein. Housing part 44 is also provided with spaced apart, generally planar standoff fins 92, as shown in FIG. 4, which may be provided to allow stacking of multiple housing parts 44 without difficult to release "nesting" of one housing part in another. For a typical blower having an airflow capacity of between 400 cubic feet per minute and 2,000 cubic feet per minute a blower housing, such as the blower housing 40, may have overall dimensions of height, measured from flange 38 to the opposite side of the housing, of up to about 18.0 inches. With such proportions of a blower housing for a conventional centrifugal blower impeller, the overall width of the blower housing 40 may be on the order of up to 15.0 inches and the diameter of the blower air inlet openings may be approximately 10.0 inches.

Accordingly, formation of housing parts, such as the housing parts 42 and 44, including compound curvatures of the walls 60 and 68, may advantageously be provided by compression molding using a bulk thermoset molding compound or a sheet molding part. In fact, using a molding composition of a type to be described further herein, the wall thickness of the walls 60 and 68 may be maintained relatively low, on the order of 0.10 inches, for example. Thus a relatively lightweight but structurally rigid housing may be provided utilizing housing parts, such as the housing parts 42 and 44, which are both compression molded of a preferred composition described above and further herein.

Figure 9:
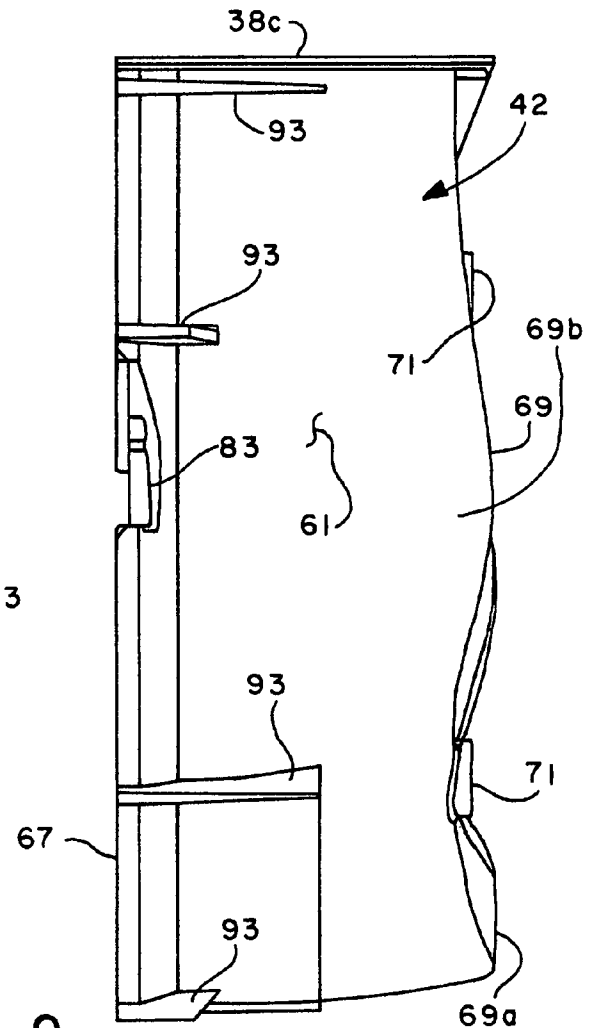
FIG. 9 is an end view of the housing part shown in FIG. 8.
Figure 8:
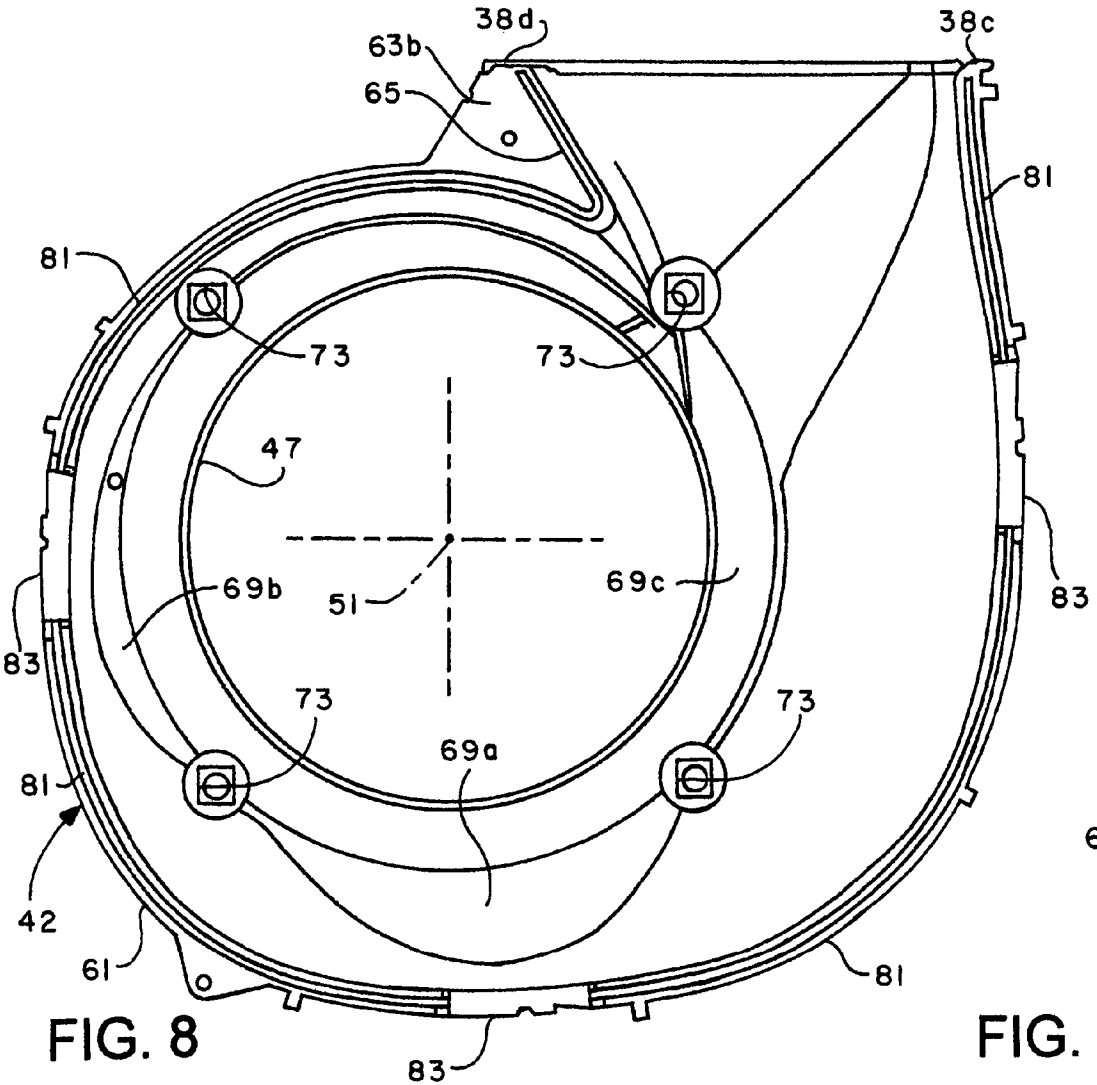
FIG. 8 is a side elevation of an opposite part of the blower housing of the present invention.
Figure 10:
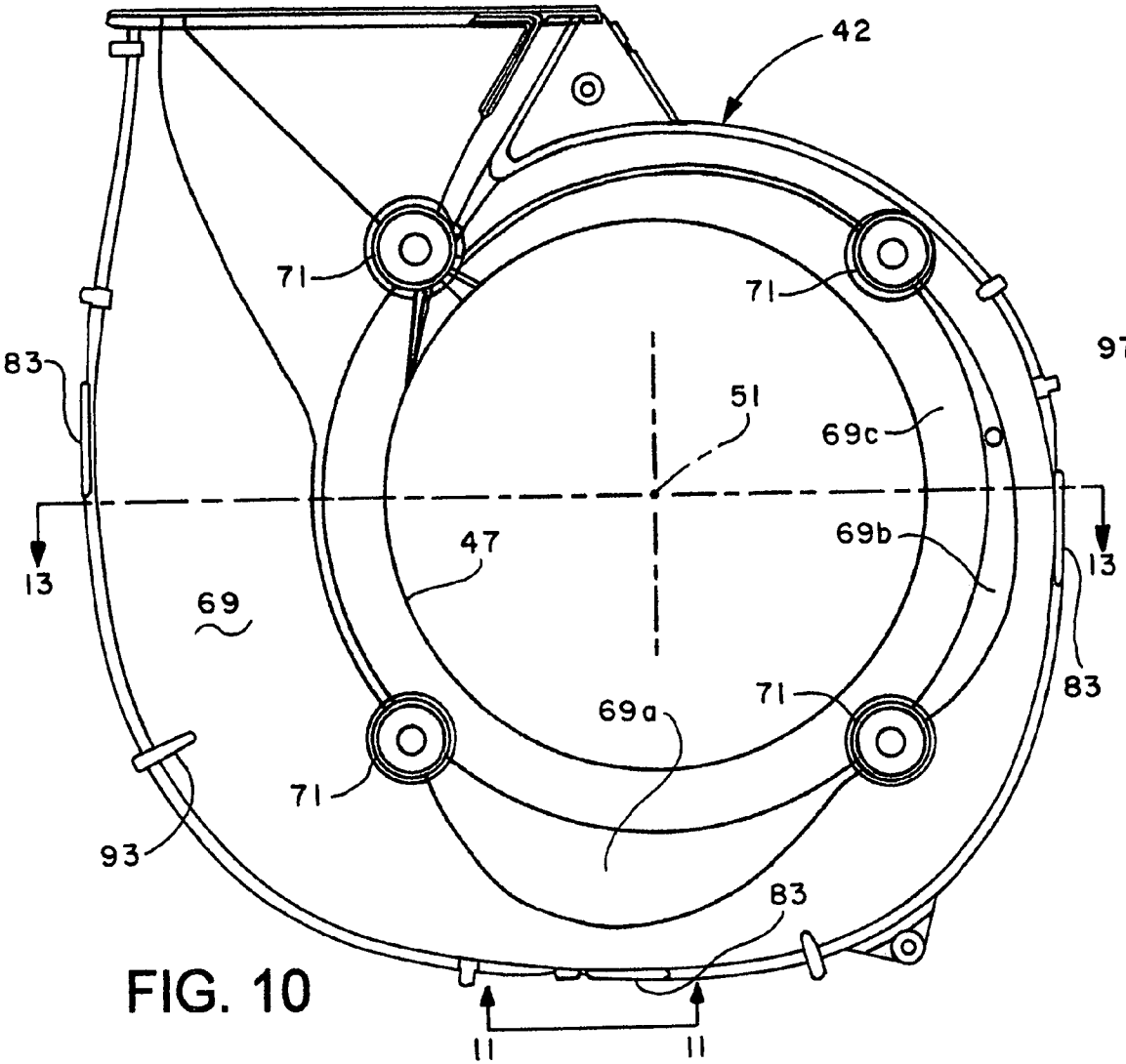
FIG. 10 is an opposite side elevation of the blower housing part shown in FIGS. 8 and 9.

Referring now to FIGS. 8, 9 and 10, the housing part 42 is, essentially, a mirror image of housing part 44. Housing part 42 includes a continuously curved outer end wall 61 which conforms in shape substantially to outer wall 60 of housing part 44. Outer wall 61 extends from a substantially planar wall portion 65 to a part of flange 38 designated by numeral 38*c* and which, in assembly with housing part 44, forms part of the continuous perimeter flange 38. Planar wall portion 65 is contiguous with a flange part 38*d* which cooperates with flange part 38*a* on housing part 44 to form part of the continuous perimeter flange 38. Housing part 42 also includes an air inlet opening 47 which is circular about axis 51 and is of the same diameter as inlet opening 46, preferably. A continuously curved sidewall 69 is interposed outer wall 61 and inlet opening 47 and has the same contour, essentially, as sidewall 68 of housing part 44, including axially projecting compound curved surfaces 69*a*, 69*b* and 69*c*, for example.

Figure 12:
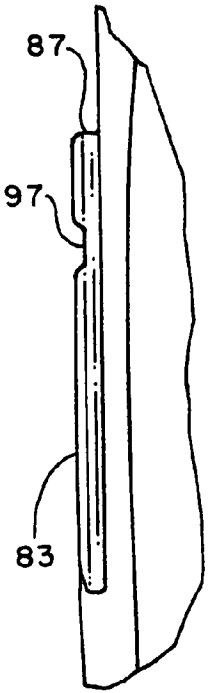
FIG. 12 is a detail side elevation of the boss shown in FIG. 11.
Figure 13:
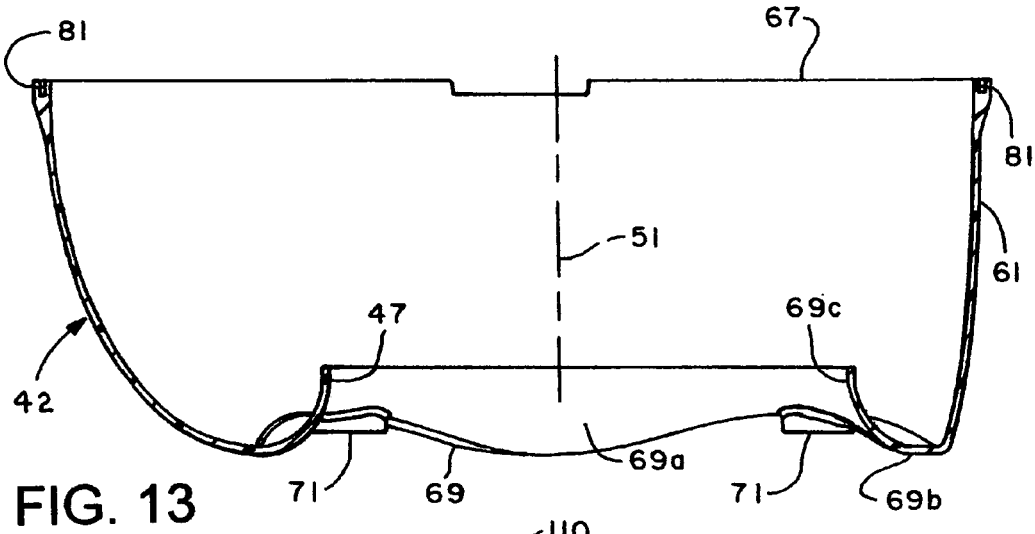
FIG. 13 is a section view taken generally from the line 13-13 of FIG. 10.

Housing parts 42 and 44 are not true mirror image parts in that housing part 42 includes a perimeter groove 81, see FIGS. 8 and 13, extending along side edge 67 and which is adapted to receive flange 80 of housing part 44 when the two parts are joined together. As shown in FIGS. 8 through 12, housing part 42 is also provided with plural spaced apart tapered bosses 83 formed integral with outer wall 61 and which are adapted to be contiguous with bosses 82 on housing part 44 when housing parts 42 and 44 are joined together, thereby forming cooperating bosses which are tapered toward each other. As shown in FIGS. 9, 10 and 13, housing part 42 is also provided with four bosses spaced apart about the axis 51 and the air inlet opening 47. Bosses 71 are preferably arranged in a pattern identical to that of bosses 70 for housing part 44 and are adapted to support the motor 48 in an alternate working position on the blower 30. In this respect, bosses 71 are provided with recesses 73, see FIG. 8, for receiving threaded nut fastener members, not shown, whereby the motor 48 may be mounted on housing part 42 in the same manner that has been described for mounting the motor 48 on housing part 44. Housing part 42 is also provided with a generally planar gusset 63*b* extending between planar wall 65 and outer wall 61 and adapted to be essentially contiguous with gusset 63*a* when the housing parts 42 and 44 are placed in assembly with each other. Housing part 42 is also provided with plural spaced apart standoff fins 93, see FIGS. 9 and 10, to facilitate anti-nesting of housing parts 42 when stacked one inside the other.

Figure 11:
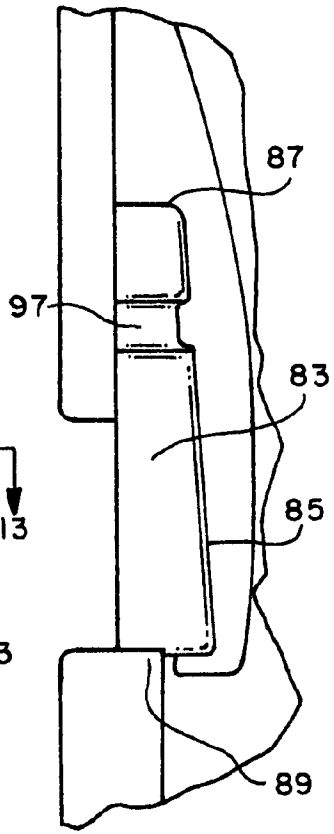
FIG. 11 is a detail plan view of a boss on the housing part shown in FIGS. 8 through 10 and taken generally from the line 11-11 of FIG. 10.

Referring briefly to FIGS. 11 and 12, the bosses 83 are each provided with a tapered side wall 85 and opposed end walls 87 and 89 together with a transverse groove 97 which is operable to be aligned with the groove 90 of a boss 82, respectively. Accordingly, housing part 42 may have, essentially, the same overall dimensions as housing part 44 and is also advantageously formed by compression molding using a bulk molding compound or a sheet molding compound of the type described herein.

Figure 15:
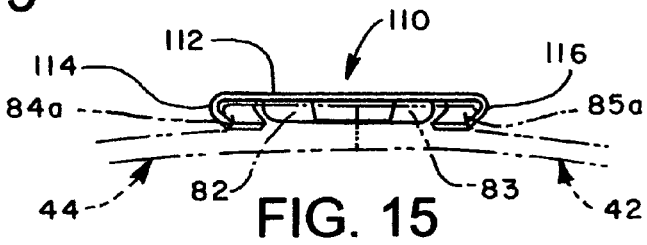
FIG. 15 is an end view of the clip shown in FIG. 14.
Figure 14:
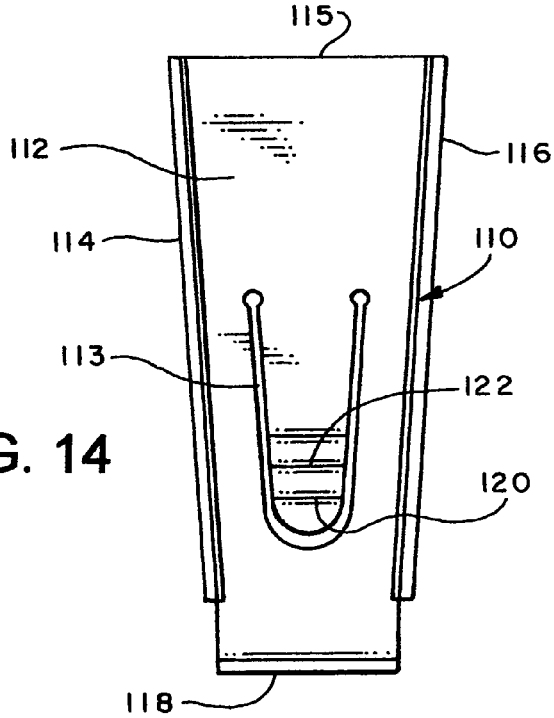
FIG. 14 is a plan view of a clip or cleat for connecting the blower housing parts together in accordance with the present invention.

Referring briefly to FIGS. 14 through 16, when housing parts 42 and 44 are placed adjacent and contiguous with each other with flange 80 disposed in groove 81, the respective pairs of bosses 82 and 83 are contiguous with each other to form a boss tapered on opposite longitudinal sides. The housing parts 42 and 44 may be secured to each other with a clip or cleat, generally designated by the numeral 110 in FIGS. 14, 15 and 16. Clip 110 is preferably formed of sheet metal and includes a generally planar body 112 and opposed tapered flanges 114 and 116, see FIG. 15, which are inclined toward each other. Body 112 also terminates at one end in a depending stop flange 118. A cantilever, elastically deflectable detent member 120 is formed on body 112 by, for example, a stamping or coining operation to remove material to define a slot 113 which defines the detent member 120. Detent member 120 includes a projection 122, see FIGS. 14 and 15, which is adapted to register in the cooperating grooves 90, 97 of the bosses 82, 83 when they are aligned. The tapered sides 84 and 85 of the respective bosses 82 and 83 may be formed with reentrant surfaces 84*a* and 85*a*, see FIGS. 15 and 16, so that the clip flanges 114 and 116 may forcibly engage the bosses 82 and 83 when the clip 110 is placed in registration with the bosses by sliding the clip at its open end 115 onto the bosses at ends 86 and 87. Clip 110 is moved toward cooperating boss ends 88 and 89 until member 120 elastically deflects and the projection 122 registers in the groove 90, 97 of the cooperating bosses.

Those skilled in the art will appreciate from the foregoing description, when taken in conjunction with the drawings, that an improved blower housing, particularly adapted for HVAC systems, is provided. The blower housing 40 is lightweight, and is advantageously molded with compound curved surfaces which aid in allowing a relatively thin wall thickness for the housing parts 42 and 44 while preserving strength. Accordingly, by using a thermoset molding composition for housing parts 42 and 44, such as a polyester resin, preferably reinforced with glass fibers in either random arrangement, or in rovings or cloths embedded in the resin, brittleness at low temperatures and creep and softness at high temperatures is minimized and operating temperatures as high as 600° F. may be experienced by blower 30, at least for predetermined periods of time in the event of failure of some component of an HVAC system. One preferred molding compound is commercially available from Premix, Inc. of North Kingsville, Ohio, as their composition Premi-Glas 2200-22CR-SX fiberglass reinforced thermoset sheet molding compound, for example.

Figure 17:
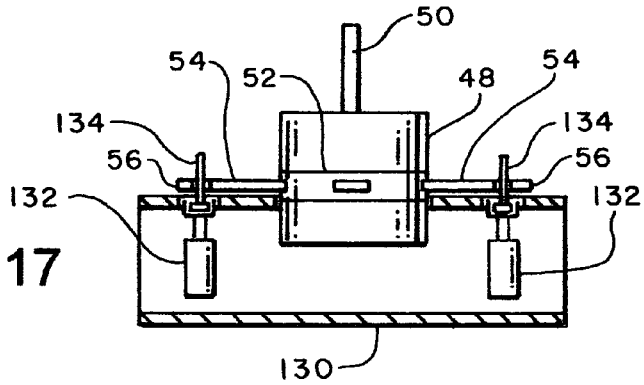
FIGS. 17 through 21 illustrate certain steps in a preferred method of assembly of an air handling blower in accordance with the present invention.
Figure 18:
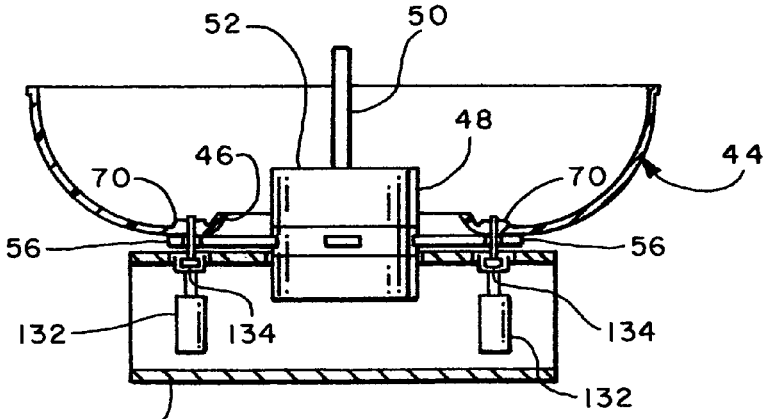

The advantageous formation of the blower housing 40 from molded housing parts 42 and 44 also provides for an improved assembly process for assembling a blower, such as the blower 30. Referring to FIG. 17, there is illustrated a fixture 130 for supporting the motor 48 together with mounting bracket 52 secured thereto. Fixture 130 is preferably provided with suitable motorized fastener drivers 132, two shown, which are operable to drive threaded fasteners, such as hexhead machine screws 134, to assemble the motor 48 to the blower housing 40 at either housing part 42 or 44. Motor 48 is assembled to housing part 44 in the example illustrated. Accordingly, the motor 48, in assembly with its support bracket 52, may be disposed on the fixture 130 with fasteners 134 projecting through suitable openings in the bosses 56. A housing part, such as housing part 44, may then be placed in the position shown in FIG. 18 and the fastener drivers 132 energized to drive the fasteners 134 into threaded engagement with the aforementioned cooperating nuts, not shown, disposed in the boss recesses 72, FIG. 3, of housing part 44.

Figure 19:
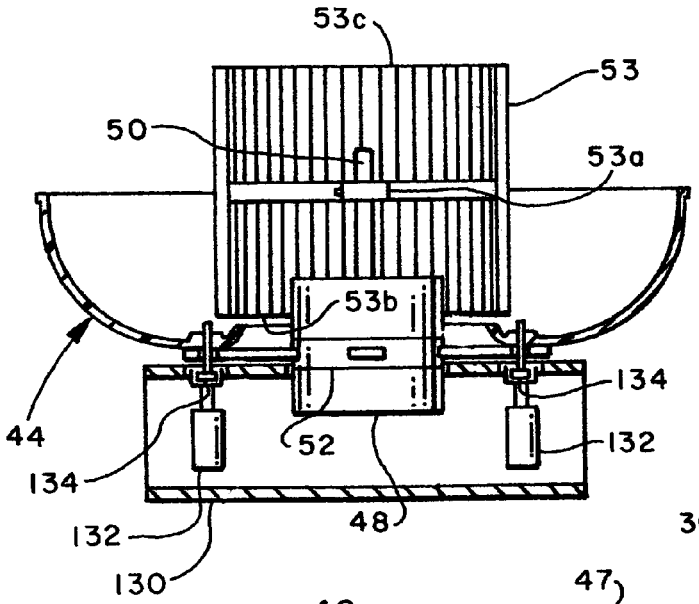

Once motor 48 has been secured to housing part 44, a centrifugal impeller, such as impeller 53, see FIG. 19, may be placed in housing part 44 and connected to shaft 50 at an impeller hub 53*a* and secured thereto in a conventional manner. One side 53*b* of impeller 53 is now disposed directly adjacent inlet opening 46 of housing part 44. The motor 48 and impeller 53 attached thereto are disposed in their working positions with respect to housing part 44. Impeller 53 is also operable to be provided of a diameter and configuration such that airflow into the impeller through opening 46 is unimpeded except by motor 48 and bracket 52.

Figure 20:
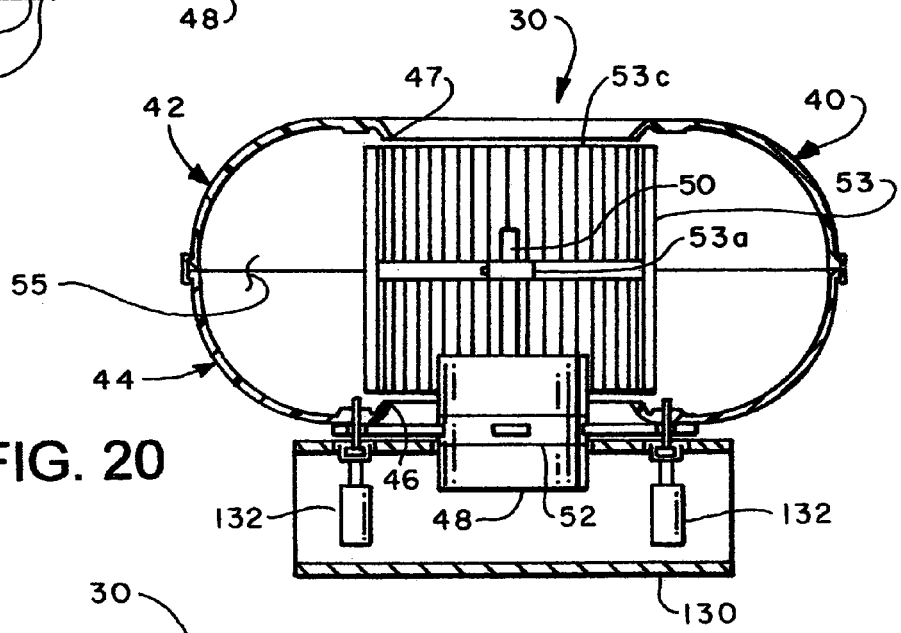

After assembly of the impeller 53 to motor output shaft 50, housing part 42 may be assembled to housing part 44 by placing housing part 42 on top of housing part 44 as illustrated in FIG. 20. At this time perimeter flange 80 of housing part 44 is registered in perimeter groove 81 of housing part 42.

Figure 21:
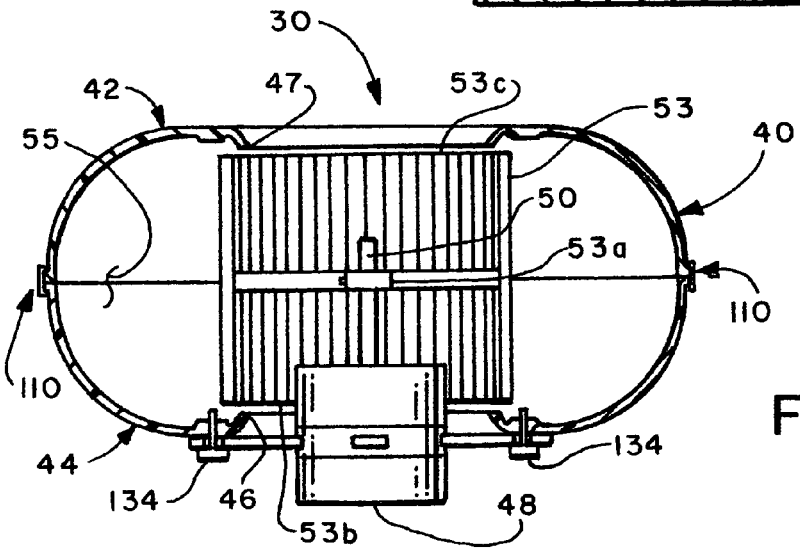

After registration of housing part 42 with housing part 44, the clips or cleats 110 are applied to the respective pairs of tapered bosses 82, 83 in the manner described previously, and as shown in FIG. 21, to finalize the assembly of the blower housing 40. Opposite side edge 53*c* of impeller 53 is now disposed closely adjacent air inlet opening 47 to allow unimpeded airflow into the impeller for discharge into blower interior airflow space 55, FIGS. 20 and 21. Lastly, the blower 30 may be removed from the fixture 130 and, as shown in FIG. 21, is now ready for further installation procedures, which may be required to complete the assembly of an HVAC unit.

Alternatively, the blower assembly 30 may be placed in storage awaiting a call for use. Accordingly, the configuration of the blower housing 40 lends itself also to an improved method of assembly. Moreover, the bolt type fasteners 134 as well as the aforedescribed threaded nuts may be reversed in their positions. For example, the bolt type fasteners 134 may be inserted from inside the housing part 44 while a maneuverable tool assembly is placed over each of the bolts and respective fastener drivers are energized to drive the bolts to secure the housing part 44 to the bracket 52. The bosses 56 could, in such an arrangement, include threaded inserts for receiving the aforementioned fasteners. Moreover, the fasteners 134 may be bayonet type non-threaded fasteners designed to engage the motor bracket bosses 56 whereby the use of nut or bolt driving tools would not be required. Still further, placement of the impeller 53 on the shaft 50 may be aided by locating hub 53*a* of the impeller against a shoulder on shaft 50, not shown, or the impeller may be located using an attachment to the fixture 130, also not shown, if desired. Placing the aforementioned nut type fasteners within the recesses 72 or 73 of the respective blower housing parts 44 or 42 prior to placement of the housing part on the fixture 130 also facilitates quick assembly of the blower 30. Still further, the slidable wedge shaped clips 110 also facilitate quick assembly of the blower housing parts 42 and 44 to each other, and disassembly, if required.

Fabrication of the blower housing 40 and assembly of the blower housing parts to each other and to the motor and impeller of the blower 30 is believed to be readily understandable to those of skill in the art based on the foregoing description. Conventional engineering materials and practices and manufacturing practices, other than those described, may be utilized in fabricating and assembling the blower 30 and the parts thereof. Although preferred embodiments of the present invention have been described herein in detail, those skilled in the art will also recognize that various substitutions and modifications may be implemented without departing from the scope and spirit of the appended claims.

What is claimed is:

1. A blower housing for a motor driven air handling blower said blower housing comprising:

a first housing part including at least a part of an air inlet opening and at least a part of an air discharge opening formed thereby;

a second housing part including at least a part of an air inlet opening and at least a part of an air discharge opening formed thereby;

said housing parts being connectable to each other to form said blower housing; and said housing parts being formed of a molded thermoset polymer composition, respectively;

wherein each of said housing parts includes at least one boss positioned to be adjacent a corresponding boss of the other of said housing parts when said housing parts are assembled one to the other, and said blower housing includes a clip adapted to engage said bosses to secure said housing parts to each other;

wherein said bosses are tapered toward each other and said clip includes opposed tapered flanges engageable with respective ones of said bosses for registering said clip with said bosses in a wedged condition; and wherein said clip includes a detent member operable to be disposed in a recess formed in at least one of said bosses for retaining said clip in a position for securing said housing parts to each other.

2. The blower housing of claim 1 wherein:

said housing parts are connectable to each other at respective peripheral edges disposed along a parting line which lies in a plane generally normal to the axis of rotation of a blower impeller adapted to be disposed in said blower housing.

3. The blower housing set forth in claim 1 wherein:

one of said housing parts includes a flange disposed along a peripheral edge and the other of said housing parts includes a groove disposed along a cooperating peripheral edge for receiving said flange for locating said housing parts in predetermined positions with respect to each other.

4. The blower housing set forth in claim 1 wherein:

said housing parts each include plural bosses spaced apart about cooperating peripheral edges of said housing parts, respective pairs of said bosses being aligned with each other when said housing parts are assembled to each other for receiving respective ones of said clips.

5. The blower housing set forth in claim 1 wherein:

said housing parts each include a curved outer wall joined to a curved sidewall and forming compound curved surfaces therebetween.

6. The blower housing set forth in claim 5 wherein:

said housing parts each include an inlet opening defined by the side wall of said housing parts, respectively, and said housing parts cooperate to provide an airflow path disposed between said inlet openings and said discharge opening which has a cross-sectional area which progressively increases toward said discharge opening.

7. The blower housing set forth in claim 6 wherein:

said cross-sectional area expands in a radial direction relative to an axis of rotation of a blower impeller in said housing over a first portion of said housing and a second portion of said housing is formed which expands in an axial direction relative to said axis.

8. The blower housing set forth in claim 1 wherein:

said thermoset composition includes a fiber reinforcement dispersed throughout said thermoset composition.

9. The blower housing set forth in claim 8 wherein:

said thermoset composition includes a polyester resin.

10. The blower housing set forth in claim 8 wherein:

said blower housing is formed by compression molding respective ones of said housing parts using said thermoset composition.

11. A blower housing for a motor driven air handling blower, said blower housing comprising:

a first housing part;

a second housing part;

said housing parts being connectable to each other along cooperating peripheral edges of said housing parts extending generally normal to an axis of rotation of a blower impeller adapted to be disposed in said blower housing; and said housing parts are formed of a molded thermoset polymer composition, respectively;

wherein each of said housing parts includes plural spaced apart bosses positioned to be adjacent corresponding bosses of the other of said housing parts when said housing parts are assembled one to the other, and said blower housing includes respective clips adapted to engage the cooperating bosses to secure said housing parts to each other;

wherein said bosses are tapered toward each other and said clips include opposed tapered flanges engageable with respective ones of said bosses for registering said clips with said bosses in a wedged condition; and wherein said clips include a detent member adapted to be disposed in a recess formed in at least one of said bosses for retaining said clip in a position for securing said housing parts to each other.

12. The blower housing set forth in claim 11 wherein:

one of said housing parts includes a flange extending along said peripheral edge of said one housing part and the other of said housing parts includes a groove disposed along said peripheral edge of said other housing part for receiving said flange for locating said housing parts in predetermined positions with respect to each other.

13. The blower housing set forth in claim 11 wherein:

said thermoset composition includes a fiber reinforcement dispersed throughout said thermoset composition.

14. The blower housing set forth in claim 13 wherein:

said blower housing is formed by compression molding respective ones of said housing parts using said thermoset composition.

15. A method of assembling an air handling blower comprising a motor, a support bracket for connecting said motor to a blower housing, an impeller wheel adapted to be connected to an output shaft of said motor and opposed housing parts adapted to be joined along cooperating edges, said method comprising the steps of:

providing a fixture for supporting at least one of said motor and said support bracket;

providing fastener driving tools for driving fasteners for securing said support bracket to one of said housing parts;

mounting said support bracket on said fixture;

mounting one of said housing parts on said support bracket;

driving fasteners to connect said support bracket to said one of said housing parts;

mounting said impeller on an output shaft of said motor;

mounting the other of said housing parts on said one housing part; and securing said housing parts together to form said blower.

16. The method set forth in claim 15 wherein:

said housing parts are provided with cooperating bosses which are registrable with each other when said housing parts are connected, and said method includes the step of:

connecting said housing parts together with a fastener engagable with said bosses, respectively.

17. The method set forth in claim 16 wherein:

said fastener comprises a clip slidably engageable with said bosses on said housing parts to secure said housing parts to each other.

18. The method set forth in claim 15 including the steps of:

mounting said motor on said fixture with its output shaft projecting substantially vertically upward and lowering said one housing part over said motor and into engagement with said support bracket prior to driving said fasteners to secure said motor and said support bracket to said one housing part.

19. The method set forth in claim 18 including the steps of:

mounting said impeller on said output shaft of said motor by lowering said impeller onto said output shaft, and locating said impeller in a predetermined position with respect to an air inlet opening formed in said one housing part.

20. The method set forth in claim 19 including the step of: lowering the other of said housing parts into engagement with said one housing part and with an air inlet opening in said other housing part disposed directly adjacent said impeller.

21. The method set forth in claim 15 including the step of: forming said housing parts of a reinforced thermoset composition, respectively.

22. The method set forth in claim 21 including the step of: forming said housing parts by compression molding said thermoset composition.

* * * * *

UNITED STATES PATENT AND TRADEMARK OFFICE

CERTIFICATE OF CORRECTION

PATENT NO. : 7,381,028 B2
APPLICATION NO. : 10/796703
DATED : June 3, 2008
INVENTOR(S) : Stephen S. Hancock et al.

It is certified that error appears in the above-identified patent and that said Letters Patent is hereby corrected as shown below:

On the title page:

Item (75), Line 1, "Glint, TX (US)" should read --Flint, TX (US)--

Signed and Sealed this

Twenty-fourth Day of February, 2009

John Doll

JOHN DOLL
*Acting Director of the United States Patent and Trademark Office*